United States Patent [19]

Ohno et al.

[11] Patent Number: 4,731,262

[45] Date of Patent: Mar. 15, 1988

[54] METHOD OF PAINTING ARTICLE FORMED OF SYNTHETIC RESIN

[75] Inventors: Masashi Ohno, Hatano; Takashi Toyama, Yokohama; Kiminori Ishii, Ebina, all of Japan

[73] Assignee: Nissan Motor Co., Ltd., Yokohama, Japan

[21] Appl. No.: 869,691

[22] Filed: Jun. 2, 1986

[30] Foreign Application Priority Data

Jun. 3, 1985 [JP] Japan ..... 60-118936

[51] Int. Cl.[4] ..... B05D 1/36; B05D 3/02; B05D 7/00

[52] U.S. Cl. ..... 427/379; 427/393.5; 427/412.1; 428/423.1; 428/423.7; 428/424.4; 428/425.3; 523/400; 524/104; 524/560; 524/597; 524/601

[58] Field of Search ..... 427/393.5, 412.1, 379; 428/423.1, 423.7, 424.4, 425.3; 524/104, 560, 597, 601; 523/400

[56] References Cited

U.S. PATENT DOCUMENTS 4,152,313 5/1979 Fogle et al. ..... 524/104
4,529,632 7/1985 Fujii et al. ..... 427/412.1 X
4,649,067 3/1987 Gras ..... 427/393.5 X

FOREIGN PATENT DOCUMENTS 130734 11/1978 Japan ..... 524/104

*Primary Examiner*—Michael R. Lusignan
*Attorney, Agent, or Firm*—Schwartz, Jeffery, Schwaab, Mack, Blumenthal & Evans

[57] ABSTRACT

Painting of an article formed of a synthetic resin, e.g. an automobile bumper formed of polyurethane resin, is accomplished by simplified operations and at reduced cost by using a paint of a desired color containing 5–40 wt % of an aprotic polar solvent, preferbly N-methyl-2-pyrrolidone. The paint is applied directly to a cleaned surface of the plastic article, followed by usual drying and baking. Application of a usual primer is omitted since the paint containing an adequate amount of aprotic polar solvent is excellent in adhesion to plastic surfaces. The obtained paint film is comparable to an ordinary top coat paint film formed on a primer layer in appearance, whether resistance and chemical resistance. When a two-toned paint coat is wished, another paint not containing any aprotic polar solvent is applied onto a selected area of the initially formed paint film, followed by drying and baking.

18 Claims, 8 Drawing Figures

METHOD OF PAINTING ARTICLE FORMED OF SYNTHETIC RESIN

BACKGROUND OF THE INVENTION

This invention relates to a method of painting an article formed of a synthetic resin such as an automobile bumper formed of a polyurethane resin.

Current automobiles employ many parts formed of synthetic resins. Various kinds of synthetic resins are used, and particularly polyurethane resins are widely used for relatively large-sized parts represented by bumpers because of excellence and balance in many properties such as moldability, toughness, flexibility and resiliency. .

Automobile parts formed of synthetic resins, and particularly ones formed of polyurethane resins, are often painted for improvement of appearance, weather resistance, chemical resistance, and so on. In the conventional painting process for such purpose an indispensable step is coating the surface of the synthetic resin part with a primer. For example, a polyurethane resin base primer containing 0.2–0.5 wt % of carbon black and 5–6 wt % of titanium oxide, a white pigment, is generally used for almost every kind of moldable synthetic resin. Such a primer is applied directly to the surface of a plastic part such as a polyurethane bumper which is cleaned in advance, and the primer coating film is solidified by drying and baking. After that a synthetic resin base top coat paint of a desired color is applied onto the primer film, followed by drying and baking. The primer film must be completely hidden by the top coat paint because every primer is inferior to top coat paints in weather resistance and chemical resistance though it is superior in adhesion to plastic surfaces.

Thus, it is necessary to employ a two-coat and two-bake process for accomplishment of monochromatic painting of a plastic article. In the case of forming a two-toned paint film it is necessary to employ a three-coat and three-bake process. That is, a top coat paint film of a desired first color formed on a primer film by the two-coat and two-bake process is masked in a desired pattern, and another top coat paint of a desired second color is applied, followed by drying and baking and then removal of the mask.

Due to indispensableness of first forming a primer coating film by the aforementioned steps including a baking step, the conventional painting process for painting articles formed of synthetic resins is complicated and time-consuming and entails high equipment costs.

SUMMARY OF THE INVENTION

It is an object of the present invention to provide a method of painting an article formed of a synthetic resin by simplified operations and at reduced labor and equipment costs.

We have accomplished this object by using a paint comprising a pigment of a desired color and an aprotic polar solvent which amounts to 5–40 wt % of the entire paint composition and by applying this paint directly to a cleaned surface of an article formed of a synthetic resin without using a usual primer. The paint applied directly to the plastic article surface turns into a solid paint film adhering strongly to the plastic surface by a usual drying and baking treatment. The paint film formed by this method has a desired color and a beautiful appearance and is excellent in weather resistance and chemical resistance. Therefore, this single-layer coat serves as a top coat in the usual sense so long as the purpose of the painting is providing a monochromatic paint coat.

In the painting method according to the invention the application of a primer is omitted since the paint containing an adequate amount of an aprotic polar solvent is excellent in adhesion to plastic surfaces. Therefore, this painting method is very simplified in operations and is remarkably lower in labor and equipment costs compared with the conventional painting method necessarily using a primer.

In the case of forming a two-toned paint film by using a method according to the invention, the object is accomplished by the steps of first forming a single-layer paint film of a desired first color by the above stated method using a paint film in a aprotic polar solvent, masking that paint film in a desired pattern, applying another paint of a desired second color not containing any aprotic polar solvent onto the masked paint film, making a drying and baking treatment and removing the mask.

As to the aprotic polar solvent in the paint used in this invention, it is suitable to use a pyrrolidone and especially it is preferred to use N-methyl-2-pyrrolidone. The aprotic polar solvent is a part of the solvent component of the paint. In at least one kind of aprotic polar solvent and at least one kind of different solvent.

The painting method according to the invention is applicable to articles formed of various synthetic resin such as, for example, polyurethane resin, polyamide resin, polyethylene terephthalate resin, polybutylene terephthalate resin, ABS resin, polycarbonate resin, epoxy resin and glass fiber reinforced polyester resin. In the automobile industry, examples of plastic articles to be painted by this method are bumpers panels and other car body parts. For current automobiles, this painting method is particularly favorable for painting of bumpers formed of polyurethane resin.

DETAILED DESCRIPTION OF THE INVENTION

Figure 1:
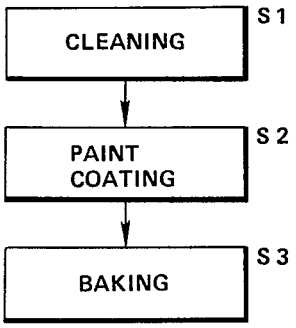
FIG. 1 is a flow chart showing the steps of a paint coating method according to the invention in its basic mode.

As stated above, in a paint coating method according to the invention it is essential to apply a paint containing an adequate amount of an aprotic polar solvent directly to the coating surface of the plastic article to be painted.

Example of aprotic polar solvents suitable for use in paint compositions are dimethylformamide, diethylformamide, dimethyl sulfoxide, tetrahydrofuran, benzonitrile and a group of pyrrolidones represented by the following general formula:

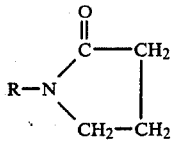

wherein R is a hydrogen atom or an alkyl group having 1 to 4 carbon atoms.

That is useful pyrrolidone include 2-pyrrolidone, N-methyl-2-pyrrolidone, N-ethyl-2-pyrrolidone, N-n-propyl-2-pyrrolidone, N-isoproyl-2-pyrrolidone, N-n-butyl-2-pyrrolidone and N-secbutyl-2-pyrrolidone. It is permissible that the paint contains two or more kinds of aprotic polar solvents so long as the total content of such solvents in the paint is 5–40 wt %.

In general it is favorable to use a pyrrolidone represented by the above general formula. Use of an alkylyrrolidone having more than 4 carbon atoms in the alkyl group is not recommended because the resultant paint is not very high in the strength of adhesion to plastic surfaces. Among the above named solvents, N-methyl-2-pyrrolidone is preferred because paints containing this solvent are distinctly superior in the ability to closely and strongly adhere to plastic surfaces.

In the paint for direct application to a plastic surface (the paint will be referred to as the primary paint), it is important that the content of the aprotic polar solvent(s) be in the range from 5 to 40 wt % of the entire paint. If the amount of this solvent component is less than 5 wt % the paint becomes inferior in the ability to adequately swell plastic surfaces when applied thereto. On the other hand, if this solvent component amounts to more than 40 wt % of the paint, it is likely that the painting operations suffer from unfavorable phenomena such as sags and runs. It is preferable that the content of the aprotic polar solvent in the primary paint is in the range from 10 to 30 wt %.

The solvent in the primary paint is a mixture of the above described aprotic polar solvent component and at least one kind of solvent which does not belong to aprotic polar solvents. The latter solvent can be selected from a variety of commonplace organic solvents such as, for example, benzene, toluene, xylene, cyclohexane, heptane, octane, decane, kerosene, ethyl acetate, isopropyl acetate, butyl acetate, methanol, ethanol, isopropanol, butanols, ethyl ether, dioxane, acetone, diethyl ketone, methyl ethyl ketone, cyclohexanone, ethylene glycol, propylene glycol, ethylene glycol monomethyl ether, ethylene glycol monoethyl ether and ethylene glycol monobutyl ether.

The vehicle component of the primary paint is a synthetic resin which may be, for example, alkyd resin, acrylate or methacrylate resin, melamine resin, acrylate-melamine resin, alkyd-melamine resin, acrylate-melamine resin, acrylate-urethane resin or epoxy resin. The content of the resin component in the primary paint is usually in the range from 5 to 30 wt % as in most of conventional paints.

Usually the primary paint contains at least one kind of colored pigment which can be selected from various pigments used in conventional top coat paints. For example, selection can be made from inorganic pigments represented by titanium dioxide, iron oxides and carbon black, organic pigments represented by phthalocyanine blue, phthalocyanine green and quinacridone red, extender pigments such as barium sulfate and calcium carbonate and metal powders represented by aluminum powder. An electroconductive pigment such as conductive carbon may additionally be contained. Optionally the primary paint may contain any of auxialiaxy additives popular in conventional paints. For example, such additive(s) may be surface conditioner such as water, acrylic polymer or silicone, reaction conditioner such as an acid or an amine, anti-sedimentation agent represented by polyamide base wax, antirunning agent, ultraviolet absorber and/or light stabilizer.

The paint to be applied onto the primary paint film may be of any type so long as it does not substantially contain any aprotic polar solvent. Suitable paints can be found in conventional paints used for top coat or middle coat. The vehicle component of such paints may be, for example, alkyd resin, acrylate or methacrylate resin, melamine resin, acrylate-alkyd resin, alkyd-melamine resin, acrylate-melamine resin or epoxy resin. The colored pigments used in these paints are as described hereinbefore with respect to the primary paint.

Figure 2:
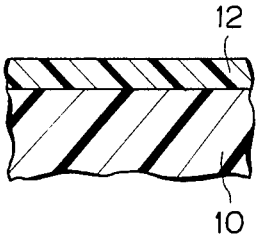
FIG. 2 is a fragmentary sectional view of a monochromatic paint film formed by the method shown in FIG. 1.

Referring to FIGS. 1 and 2, in a basic mode a painting method according to the invention has only three steps. The first step S1 is cleaning the surface of an article 10 formed of a synthetic resin which is the object of painting. The cleaning is accomplished by using well known techniques such as degreasing treatment with alkali and/or vapor cleaning treatment using an organic chlorine-containing solvent such as 1,1,1-trichloroethane, 1,1,2-trichloro-1,2,2-trifluoroethane or carbon tetrachloride. At the next step S2 a primary paint containing an aprotic polar solvent, preferably N-methyl-2-pyrrolidone, is applied to the cleaned surface of the plastic article 10 by using a conventional means such as, for example, an air spray coater or an electrostatic spray coater. The final step S3 is baking the paint coating film after drying. Though the baking condition is not strictly limited, in most cases it is suitable to perform baking at 50°–180° C., and preferably at 70°–150° C., for 20–180 min and preferably for 30–60 min. As the result, a solid and single-layer paint film 12 is provided on the desired surface of the plastic article 10. It is suitable to control the operation at the step S2 such that the solidified paint film 12 has a thickness of about 10–50 μm, and preferably about 15–40 μm. This paint film 12 adheres closely and strongly to the plastic article surface and has a desired color. Therefore, no additional coat is needed on this paint film 12 when the purpose of the painting is to obtain a monochromatic paint film.

Figure 3:
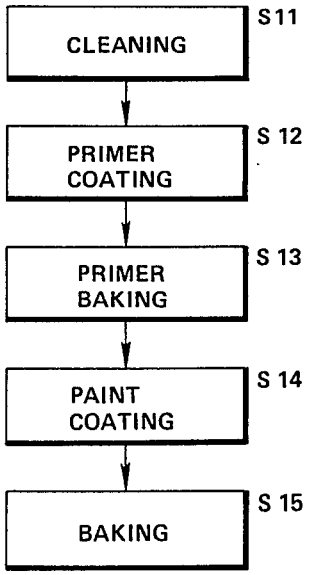
FIG. 3 (PRIOR ART)
FIG. 3 is a flow chart showing the steps of a conventional paint coating method.
Figure 4:
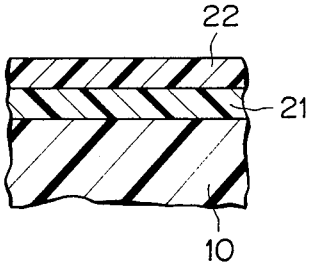
FIG. 4 (PRIOR ART)
FIG. 4 is a fragmentary sectional view of a monochromatic paint film formed by the method shown in FIG. 3.

Referring to FIGS. 3 and 4, a conventional painting method for providing the same plastic article with a monochromatic coat includes two steps additional to the three steps shown in FIG. 1. The initial cleaning step S11 is a counterpart of the step S1 in FIG. 1. At the next step S12 a primer is applied to the plastic article surface, followed by drying and baking at the step S13. By these three steps the plastic article surface is coated with a solid film of primer 21. To form a top coat paint film 22 of a desired color on the primer film 21, the painting process needs to include another paint coating step S14 where a top coat paint is applied onto the primer film 21 and another baking step S15 where the top coat paint film 22 is solidified.

Figure 5:
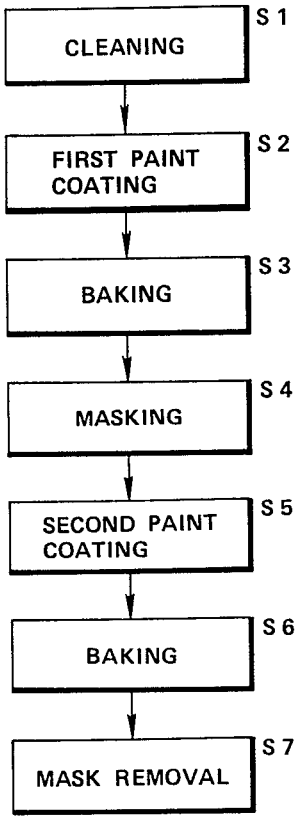
FIG. 5 is a flow chart showing the steps of a paint coating method according to the invention in the two-coat two-bake mode.
Figure 6:
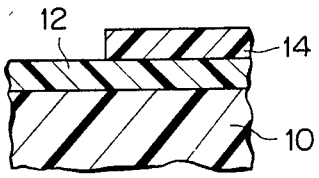
FIG. 6 is a fragmentary sectional view of a two-toned paint film formed by the method shown in FIG. 5.

When a painting method according to the invention is used to provide the plastic article 10 with a two-toned and partly two-layered paint film, several steps are added to the process shown in FIG. 1. Referring to FIGS. 5 and 6, first the surface of the plastic article 10 is coated with a paint film 12 of a desired first color by the already described steps S1, S2 and S3 using a primary paint containing an aprotic polar solvent. Then, at the step S4 the paint film 12 is masked (not illustrated) in a desired pattern. At the next step S5 a top coat paint of desired second color, which does not contain any aprotic polar solvent, is applied onto the masked paint film 12. At the next step S6 the top coat paint film is dried and baked usually at 50°–180° C. and preferably at 70°–150° C., for 20–180 min and preferably for 30–60 min. At the final step S7 the mask is removed. As the result, selected areas of the initially formed paint film 12 is coated with a top coat paint film 14 of a different color, so that the plastic article 10 is coated with a two-toned and partly two-layered paint film. Usually the thickness of the top coat paint film 14 is about 10–50 μm, and preferably about 15–40 μm.

Figure 7:
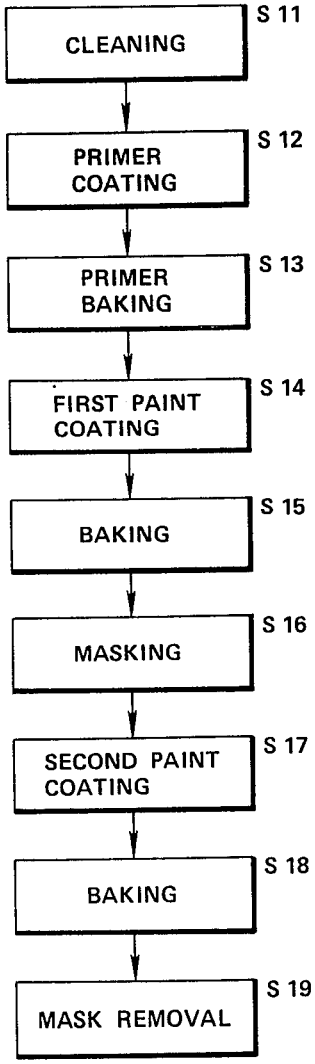
FIG. 7 (PRIOR ART)
FIG. 7 is a flow chart showing the steps of a conventional paint coating method to form a two-toned paint film.
Figure 8:
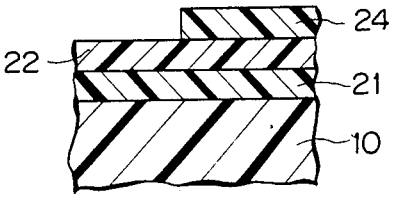
FIG. 8 (PRIOR ART)
FIG. 8 is a fragmentary sectional view of a two-toned paint film formed by the method shown in FIG. 7.

Referring to FIGS. 7 and 8, in the case of accomplishing the same object by the conventional painting process the four steps S16 to S19 corresponding to the steps S4 to S7 in FIG. 5 are added to the process of FIG. 3. As the result, selected areas of the top coat paint film 22 shown in FIG. 4 are covered with another top coat paint film 24 of a different color, so that the plastic article 10 is provided with a two-toned and partly three-layered coating film.

The advantage of the painting method according to the invention will be apparent from either a comparison between FIG. 1 and FIG. 3 or a comparison between FIG. 5 and FIG. 7.

The invention will further be illustrated by the following nonlimitative examples.

EXAMPLE 1

The object of painting was an automobile bumper formed of polyurethane. First the bumper was degreased by treatment with vapor of 1,1,1-trichloroethane.

As a primary paint according to the invention a plasticized acrylate-melamine resin base paint (a trail product codename PLAGLOSS No. 5500A, Metallic Gray) was used. This paint contained 20 wt % of N-methyl-2-pyrrolidone as one component of the solvent. The viscosity of the paint, measured by Ford cup No. 4 at 20° C., was adjusted to 14 sec. The paint was applied directly to the polyurethane bumper by an air spray coating method, followed by drying and baking at 120° C. for 30 min. The thickness of the resultant paint film was 18 μm. The paint film had a brilliant appearance comparative to an ordinary top coat or middle coat.

As a top coat paint, a plasticized acrylate-melamine resin base paint (PLAGLOSS No. 5500, Metallic Red) not containing any aprotic polar solvent was used. The viscosity of the paint, measured by Ford cup No. 4 at 20° C., was adjusted to 20 sec. The primary paint film was masked in an arbitrary pattern, and the top coat paint was applied by an air spray coating method, followed by drying and baking at 120° C. for 30 min. The thickness of the resultant top coat was 29 μm. After that the mask was removed. As the result a two-toned and partly two-layered coating structure as represented by FIG. 6 was obtained.

The partly two-layered paint film was subjected to the following tests, using test pieces cut out of the painted bumper.

ADHESION STRENGTH TEST

The paint film was scribed with a knife blade to draw parallel lines in a square grid pattern so as to define 100 squares each of which was 1 mm×1 mm in widths. The scribing was made to such a depth that the knife blade touched the polyurethane surface. A piece of tacky cellophane tape was stuck onto the scribed region of the paint film. Then the cellophane tape was peeled from each test piece in one motion. After that the number of the 1 mm×1 mm squares in which the paint film remained unpeeled and undamaged was counted for evaluation of the adhesion strength of the paint film. In the test piece of Example 1 the healthy squares counted 100. That is, peeling of the paint film did not occur in any of the 100 squares.

APPEARANCE OF PAINT COAT

Surface smoothness of the paint film was evaluated by visual observation. A very good mark was given to the paint film of Example 1.

INITIAL GLOSS

Initial gloss of the paint film was measured by the 60°–60° specular gloss measuring method. The specular gloss value of the sample of Example 1 was 95.

ACID RESISTANCE TEST 0.2 ml of 5% aqueous solution of sulfuric acid was dropped on the paint film surface on a test piece, and the test piece was held horizontally for 4 hr at 20° C. After that the test piece was washed with water, and the paint film was carefully observed to detect any change such as discoloration, spotting or swelling. In the sample of Example 1 no change was detected.

GASOLINE RESISTANCE TEST

A test piece was immersed in gasoline for 30 min. After that the paint film was carefully observed to detect any change such as discoloration, spotting, swelling or peeling. In the sample of Example 1 no change was detected.

WEATHERING TEST

Several test pieces were subjected to a weathering test using a QUV accelerated weathering tester. In this test, a sequence of irradiation with ultraviolet rays for 8 hr at 70° C. and dewing at 50° C. for 4 hr was cycled. In the unpolished state the gloss of the tested paint film sample was measured for comparison with the initial gloss value. On the sample of Example 1 the gloss value after the weathering test was measured to be 92.

EXAMPLES 2–5

In these examples the two-coat process in Example 1 was repeated by using different kinds of paints, and by changing the baking temperature in some cases, as described below.

In Example 2, the primary paint was a plasticized acrylate-melamine resin base paint (solid color) containing 25 wt % of N-methyl-2-pyrrolidone. The top coat paint was a plasticized acrylate-melamine resin base paint (solid color) not containing any aprotic polar solvent. The viscosity (Ford cup No. 4, at 20° C.) of the primary paint was adjusted to 14 sec and the viscosity of the top coat paint to 20 sec. The primary paint coat and the top coat were each dried and baked at 120° C. for 30 min. The primary paint film was 20 μm in thickness and the top coat film was 26 μm.

In Example 3, the primary paint was a plasticized acrylate-melamine resin base paint (metallic color) containing 20 wt % of N-methyl-2-pyrrolidone. The top coat piant was a plasticized acrylate-urethane resin base paint not containing any aprotic polar solvent. The viscosity of the primary paint was adjusted to 14 sec and the viscosity of the top coat paint to 18 sec. The primary paint film and the top coat were each dried and baked at 120° C. for 30 min. The primary paint film was 16 μm in thickness and the top coat film was 31 μm.

In Example 4, the primary paint was a rigid acrylate-melamine resin base paint (solid color) containing 25 wt % of N-methyl-2-pyrrolidone. The top coat paint was a rigid acrylate-melamine resin base paint not containing any aprotic polar solvent. The viscosity of the primary paint was adjusted to 14 sec and the viscosity of the top coat paint to 25 sec. The primary paint film and the top coat were each dried and baked at 140° C. for 30 min. The primary paint film was 21 μm in thickness and the top coat film was 29 μm.

In Example 5, the primary paint was a plasticized acrylate-urethane resin base paint (metallic color) containing 20 wt % of N-methyl-2-pyrrolidone. The top coat paint was a plasticized acrylate-urethane resin base paint not containing any aprotic polar solvent. The viscosity of the primary paint was adjusted to 14 sec and the viscosity of the top coat paint to 18 sec. The primary paint film and top coat were each dried and baked at 80° C. for 30 min. The primary paint film was 16 μm in thickness and the top coat was 30 μm.

The partly two-layered paint film samples of Examples 2–5 were subjected to the tests described hereinbefore. Every test on these samples gave very good result comparable to the test result on the paint film sample of Example 1. In the adhesion strength test on the sample of every example, the 100 squares all remained undamaged after peeling the cellophane tape. Initially the two-toned paint film on the sample of every example had a very good and brilliant appearance. The initial specular gloss value was 96 in Example 2, 96 in Example 3, 95 in Example 4 and 94 in Example 5. In the acid resistance test and also in the gasoline resistance test, no change was detected in the sample of every example. After the weathering test the specular gloss value was measured to be 94 in Example 2, 94 in Example 3, 93 in Example 4 and 92 in Example 5.

What is claimed is:

1. A method of painting an article formed of a synthetic resin, comprising the steps of:

applying a bake-curable paint comprising a pigment of a desired color and an aprotic polar solvent which comprises from about 5 to about 40 wt % of the entire paint directly to a cleaned surface of the article formed of the synthetic resin; and drying and baking the paint applied to said surface to thereby form a solid paint film of a desired color on said surface.

2. A painting method according to claim 1, wherein said aprotic polar solvent comprises a pyrrolidone.

3. A painting method according to claim 1, wherein said aprotic polar solvent is N-methyl-2-pyrrolidone.

4. A painting method according to claim 3, wherein the amount of said aprotic polar solvent in said paint is from about 10 to about 30 wt %.

5. A painting method according to claim 1, wherein said paint further comprises a second solvent different from any one of a class of aprotic polar solvents and a dissolved synthetic resin.

6. A painting method according to claim 1, further comprising the steps of applying in the absence of an aprotic polar solvent a second paint which comprises a pigment of a second desired color onto said paint film, and drying and baking said second paint applied onto said paint film to thereby provide an at least partly two-layered paint coating.

7. A painting method according to claim 1, further comprising the steps of applying in the absence of an aprotic polar solvent a second paint which comprises a pigment of a second desired color onto a desired area of said paint film, and drying and baking said second paint applied to said area to thereby provide a two-toned and partly two-layered paint coating.

8. A method of painting an automobile bumper formed of a polyurethane resin, comprising the steps of:

applying a paint comprising a pigment of a desired color and N-methyl-2-pyrrolidone comprising at least a portion of the solvent in the paint and comprising from about 5 to about 40 wt % of the entire paint directly to a cleaned surface of the bumper; and drying and baking said paint applied to said surface to thereby form a solid paint film of said desired color on said surface.

9. A painting method according to claim 8, wherein the amount of said N-methyl-2-pyrrolidone in said paint is from about 10 to about 30 wt %.

10. A painting method according to claim 1, wherein said paint further comprises a synthetic resin in an amount of from about 5 to about 30 wt %.

11. A painting method according to claim 1, wherein said baking occurs at a temperature of from about 50° to about 180° C. for a period of from about 20 to about 180 minutes.

12. A painting method according to claim 1, wherein said baking occurs at a temperature of from about 70° to about 150° C. for a period of from about 30 to about 60 minutes.

13. A painting method according to claim 1, wherein said solid paint film comprises a thickness of from about 15 to about 40 μm.

14. A painting method according to claim 3, wherein the amount of said aprotic polar solvent is 20 wt %.

15. A painting method according to claim 3, wherein the amount of said aprotic polar solvent is 25 wt %.

16. A paint composition for painting synthetic resins comprising:

5–30 wt. % of a synthetic resin selected from the group consisting of alkyd resin, acrylate resin, methacrylate resin, melamine resin, acrylate-melamine resin, acrylate-urethane resin and epoxy resin;

5–40 wt. % of an aprotic polar solvent;

a second solvent that is not an aprotic polar solvent; and at least one pigment.

17. A paint composition as in claim 16 wherein the aprotic polar solvent is a pyrrolidone represented by the following formula:

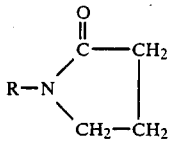
wherein R is a hydrogen atom or an alkyl group having 1 to 4 carbon atoms.
18. A paint composition as in claim 17 wherein the aprotic polar solvent is N-methyl-2-pyrrolidone.
* * * * *